US007048971B2

(12) United States Patent
Arora

(10) Patent No.: US 7,048,971 B2
(45) Date of Patent: May 23, 2006

(54) MAKING INVISIBLE LOGOS USING HYDROPHOBIC AND HYDROPHILIC COATINGS

(75) Inventor: Pramod K. Arora, North Royalton, OH (US)

(73) Assignee: Innovation Chemical Technologies, Ltd., Cleveland, OH (US)

( * ) Notice: Subject to any disclaimer, the term of this patent is extended or adjusted under 35 U.S.C. 154(b) by 359 days.

(21) Appl. No.: 10/426,727

(22) Filed: Apr. 30, 2003

(65) Prior Publication Data

US 2003/0207090 A1 Nov. 6, 2003

Related U.S. Application Data

(60) Provisional application No. 60/376,707, filed on May 1, 2002.

(51) Int. Cl.
*B05D 1/36* (2006.01)

(52) U.S. Cl. ..... 427/402; 427/240; 427/248.1; 427/282; 427/294; 204/192.1

(58) Field of Classification Search ..... 427/248.1, 427/282; 204/402, 240, 294, 192.1
See application file for complete search history.

(56) References Cited

U.S. PATENT DOCUMENTS 4,193,942 A 3/1980 Gerritsen et al.
4,855,176 A * 8/1989 Ohwaki et al. ..... 428/195.1
4,904,479 A * 2/1990 Illum ..... 424/490
4,912,298 A 3/1990 Daniels et al.
5,078,791 A 1/1992 Singh et al.
5,081,192 A 1/1992 Tatemoto
5,084,302 A 1/1992 Inoue et al.
5,096,814 A 3/1992 Aivasidis et al.
5,106,561 A 4/1992 Singh et al.
5,166,000 A 11/1992 Singh et al.
5,372,851 A 12/1994 Ogawa et al.
5,449,200 A 9/1995 Andric et al.
5,626,654 A * 5/1997 Breton et al. ..... 106/31.33
5,633,109 A * 5/1997 Jennings et al. ..... 430/115
5,645,939 A 7/1997 Yoneda et al.
5,766,698 A * 6/1998 Singh et al. ..... 427/601
5,844,225 A 12/1998 Kimock et al.
5,897,918 A * 4/1999 Singh et al. ..... 427/352
5,942,444 A 8/1999 Rittenburg et al.
6,057,042 A 5/2000 Shimotsu
6,143,358 A 11/2000 Singh et al.
6,166,855 A 12/2000 Ikeyama et al.
6,171,529 B1 1/2001 de Marignan et al.
6,171,652 B1 1/2001 Singh et al.
6,183,872 B1 2/2001 Tanaka et al.
6,281,468 B1 8/2001 Souel et al.
6,284,908 B1 9/2001 Loy et al.
6,340,734 B1 1/2002 Lin et al.

(Continued)

OTHER PUBLICATIONS

Hoffman, Patrick W., et al.; "Vapor Phase Self-Assembly of Fluorinated Monolayers on Silicon and Germanium Oxide"; Langmuir 1997, 13, 1877-1880.

(Continued)

*Primary Examiner*—Bret Chen
(74) *Attorney, Agent, or Firm*—Amin & Turocy, LLP

(57) ABSTRACT

Invisible logos may be made by forming a hydrophilic coating and a hydrophobic coating on a substrate surface, so that a portion of the hydrophilic coating and a portion of the hydrophobic coating are exposed. The invisible logos are undetectable to the human eye, but may be temporarily viewed in response to stimuli.

20 Claims, 1 Drawing Sheet

U.S. PATENT DOCUMENTS

| | | | | |
|---|---|---|---|---|
| 6,350,397 | B1 * | 2/2002 | Heikkila et al. | 264/39 |
| 6,723,814 | B1 * | 4/2004 | Meier et al. | 526/279 |
| 2005/0018013 | A1 * | 1/2005 | Nelson et al. | 347/44 |

OTHER PUBLICATIONS

Brzoska, J.B., et al.; "Silanization of Solid Substrates: A Step Toward Reproducibility"; Langmuir 1994, 10, 4367-4373.

Jansen, F., et al.; "Thin Film Deposition on Inside Surfaces by Plasma Enahanced Chemical Vapor Deposition"; Thin Solid Films 252 (1994) 32-37.

Parikh, A.N. et al.; "n-Alkylsiloxanes: From Single Monolayers to Layered Crystals. The Formation of Crystalline Polymers from the Hydrolysis of n-Octadecyltrichlorosilane"; J. Am. Chem. Soc. 1997, 199, 3135-3143.

Baney, R., et al.; "Silsesquioxanes"; Chem. Rev. 1995, 1409-1430.

Moore, J.A., et al.; "Chemical Vapor Deposition of Fluorinated Polymers"; Polymer Preprint, 1993, 34, p. 427-428.

Nason, T.C., et al.; "Deposition of Amorphous Fluoropolymer Thin Films by Thermolysis of Teflon Amorphous Fluoropolymer," App. Phys. Lett. 60, (15) Apr. 13, 1992, no page numbers.

Feher, F., et al.; "Enhanced Silylation Reactivity of a Model for Silica Surfaces"; J. Am. Chem. Soc. 1990, 112, 1931-1936.

Shea, K.J., et al.; "Arylsilsesquioxane Gels and Related Materials. New Hybrids or Organic and Inorganic Networks"; J. Am. Chem. Soc. 1992, 114, 6700-6710.

Elsevier, Ruth A.; "Vacuum Technology"; 1990, 311-319.

International Search Report; PCT/US03/13365; Aug. 29, 2003.

* cited by examiner

MAKING INVISIBLE LOGOS USING HYDROPHOBIC AND HYDROPHILIC COATINGS

RELATED APPLICATIONS

This application claims priority to provisional application Ser. No. 60/376,707 filed May 1, 2002, the contents of which are incorporated herein.

FIELD OF THE INVENTION

The present invention generally relates to invisible logos. In particular, the present invention relates to forming invisible logos on a substrate using hydrophobic and hydrophilic coatings.

BACKGROUND OF THE INVENTION

Providing information on a substrate is commonly achieved by affixing a label with the information, painting/printing the information, or forming a structure, such as an indentation. Affixing a label, painting/printing, and forming a structure involve visible information media that may obstruct or aesthetically impair the substrate. For example, information in the form of a trademark may be printed on a lens with a visible ink. The printed trademark obstructs the transmission of some light through the lens, obstructing the view through the lens.

SUMMARY OF THE INVENTION

The following is a summary of the invention in order to provide a basic understanding of some aspects of the invention. This summary is not intended to identify key/critical elements of the invention or to delineate the scope of the invention. Its sole purpose is to present some concepts of the invention in a simplified form as a prelude to the more detailed description that is presented later.

One aspect of the invention relates to an invisible logo, undetectable to the human eye, that may be temporarily viewed in response to stimuli. The invisible logo is made by forming a hydrophilic coating and a hydrophobic coating on a substrate surface, so that a portion of the hydrophilic coating and a portion of the hydrophobic coating are exposed. Using stimuli, the hydrophobic portion of the substrate surface undergoes a temporary, visible change in appearance while the hydrophilic portion of the substrate surface does not undergo a temporary, visible change. As a result, in the absence of stimuli, substrates do not convey information or display markings or ornamentation.

Another aspect of the invention relates to methods of making an invisible logo undetectable to a human eye on a substrate involving forming a hydrophilic coating over a first portion of the substrate, and forming a hydrophobic coating comprising an amphiphilic material over a second portion of the substrate; or forming a hydrophobic coating comprising an amphiphilic material over a first portion of the substrate, and forming a hydrophilic coating over a second portion of the substrate.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
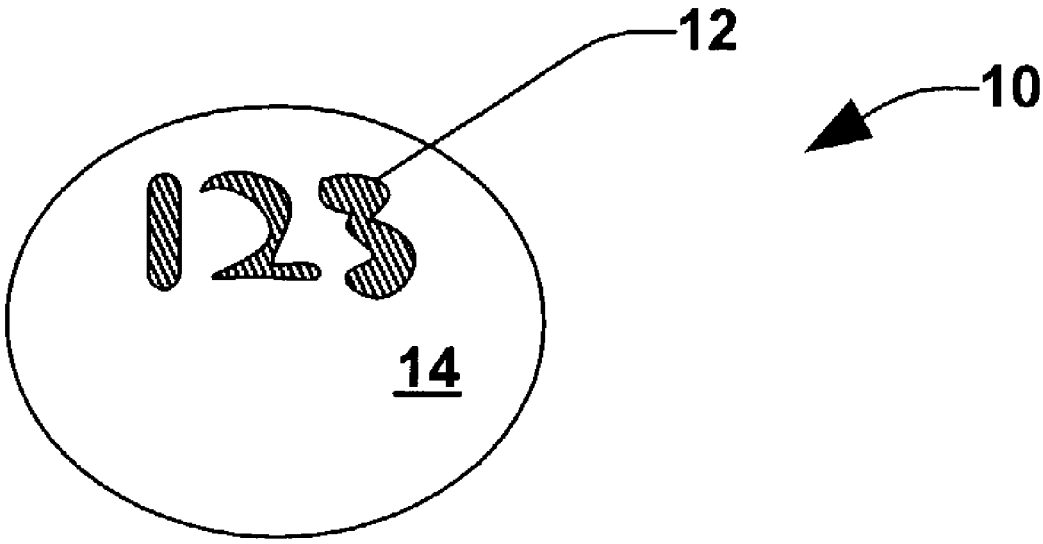
FIG. 1 is a top down view of a lens under stimulation with a logo made of hydrophobic coating (that undergoes temporary change in response to stimuli) disposed within a hydrophilic coating in accordance with one aspect of the present invention.

A substrate surface having a hydrophilic coating on one portion and a hydrophobic coating on the other portion forms the invisible logo. To the naked eye, it is not readily apparent which portions of the substrate surface have a hydrophilic coating and which portions have a hydrophobic coating. That is, the invisible logo is undetectable to the naked human eye. The hydrophilic coating and the hydrophobic coating are positioned in a manner to permit the temporary detection of information by the naked eye when the hydrophobic portion of the substrate surface undergoes a temporary, visible change in response to stimuli. Invisible means that the hydrophobic and hydrophilic coatings are optically transparent, or substantially optically transparent, in the visible region of the spectrum, which may have the same or different refractive index with respect to the substrate refractive index.

In one embodiment, substantially optically transparent means that at least about 60% of the light in the visible region of the spectrum passes therethrough. In another embodiment, substantially optically transparent means that at least about 75% of the light in the visible region of the spectrum passes therethrough. In yet another embodiment, substantially optically transparent means that at least about 90% of the light in the visible region of the spectrum passes therethrough. The visible region of the spectrum includes light having a wavelength of about 350 nm or more and about 750 nm or less.

A logo, for purposes of this invention, is a symbol(s), mark(s) or design(s) that convey information. For example, a logo can be a designation of maker/distributor, alphanumeric characters, bar code information, art work, a design associated with a person, place, company, or thing, and the like.

Generally speaking, the invisible logo made of hydrophilic coating on one portion and a hydrophobic coating on the other portion can be fabricated in a number of different methods. For example, in one embodiment, a hydrophilic coating is formed over a substrate surface (such as substantially the entire surface), followed by depositing a hydrophobic coating over a portion of the hydrophilic coating. This can be accomplished with an applicator, such as a stamp, brush, or pen, or by masking portions of the hydrophilic coating and depositing the hydrophobic coating in the unmasked portions.

In another embodiment, the hydrophilic coating is formed over a substrate surface (such as the entire surface or a substantial portion of the surface), portions of the hydrophilic coating are masked, and a hydrophobic coating is formed in the unmasked portions by oxidizing the exposed portions of the hydrophilic coating.

In yet another embodiment, the hydrophobic coating is formed over a substrate surface (such as the entire surface or a substantial portion of the surface), followed by depositing a hydrophilic coating over a portion of the surface. This can be accomplished with an applicator, such as a stamp, brush, or pen, or by masking portions of the hydrophobic coating and depositing the hydrophilic coating in the unmasked portions.

In still yet another embodiment, a hydrophilic coating is formed over a substrate surface (such as the entire surface or a substantial portion of the surface), followed by forming a hydrophobic coating over the hydrophilic coating, followed by masking a portion of the hydrophobic coating and removing the unmasked portions of the hydrophobic coating to expose portions of the initially formed hydrophilic coating. Alternatively, using an applicator, such as a stamp, brush, or pen, portions of the hydrophobic coating can be selectively removed (without using a mask) using an etching solution to expose portions of the initially formed hydrophilic coating.

In another embodiment, a hydrophobic coating is formed over a substrate surface (such as the entire surface or a substantial portion of the surface), followed by forming a hydrophilic coating over the hydrophobic coating, followed by masking a portion of the hydrophilic coating and removing the unmasked portions of the hydrophilic coating to expose portions of the initially formed hydrophobic coating. Alternatively, using an applicator, such as a stamp, brush, or pen, portions of the hydrophilic coating can be selectively removed (without using a mask) using an etching solution to expose portions of the initially formed hydrophobic coating.

In another embodiment, a hydrophilic coating is formed over a substrate surface (such as the entire surface), a hydrophobic coating is formed over the hydrophilic coating, portions of the hydrophobic coating are masked, and the unmasked portions of the hydrophobic coating are oxidized changing the unmasked portions of the hydrophobic coating to a hydrophilic coating.

It is noted that a substrate surface has a hydrophilic coating on one portion and a hydrophobic coating on another portion thereby forming the invisible logo. In this context, the substrate surface referred to is the uppermost surface, so that a substrate surface having a hydrophilic coating on one portion and a hydrophobic coating on another portion may be constituted by a substrate surface having a hydrophilic coating over the entire surface and a hydrophobic coating on a portion of the hydrophilic coating (or a substrate surface having a hydrophobic coating over the entire surface and a hydrophilic coating on a portion of the hydrophobic coating). Alternatively, the substrate surface may have a hydrophilic coating on one portion and a hydrophobic coating on another portion, without any overlap.

Stimuli induces a temporary reduction in the optical transparency of the hydrophobic coating without changing the optical transparency of the hydrophilic coating. The reduction in transparency is noticeable to human eye such that the shape of the hydrophobic/hydrophilic interfaces are identifiable and information detected. The stimuli is typically contact with air containing a relatively high amount of water vapor, such as from a human exhalation. In one embodiment, the optical transparency of the hydrophobic coating is temporarily lowered by at least about 20%. In another embodiment, the optical transparency of the hydrophobic coating is temporarily lowered by at least about 30%. In yet another embodiment, the optical transparency of the hydrophobic coating is temporarily lowered by at least about 40%.

The reduction in the optical transparency of the hydrophobic coating is temporary in that after a short time, the original relatively high optical transparency is reached. In one embodiment, temporary means about 0.1 second or more and about 1 minute or less. In another embodiment, temporary means about 0.5 seconds or more and about 30 seconds or less.

Stimuli also includes a liquid wipe where an aqueous liquid beads over the hydrophobic coating while wetting the hydrophilic coating or an organic liquid that beads over the hydrophilic coating while wetting the hydrophobic coating. Liquids include water, colored water, inks, and organic solvents (such as alcohols). Liquid stimuli are particularly suitable when the substrate is not transparent. The liquid stimuli can be applied using any suitable applicator including a sponge, cloth, spray, and the like. The change induced by liquid stimuli tends to last longer than the change induced by water vapor stimuli.

Stimuli also includes a change in temperature inducing condensation of water vapor from air on the hydrophilic coating. This typically occurs when there is an increase in temperature of at least about 15° C.

Referring to FIG. 1, a substrate 10 having a hydrophobic coating 12 over a portion thereof and a hydrophilic coating 14 over a portion thereof is shown. The substrate is shown just after it is exposed to stimuli. The hydrophobic coating 12 in the form of a logo has its optical transparency lowered while the optical transparency of the hydrophilic coating 14 does not change. In this instance, a number becomes evident to human eye conveying information.

Figure 2:
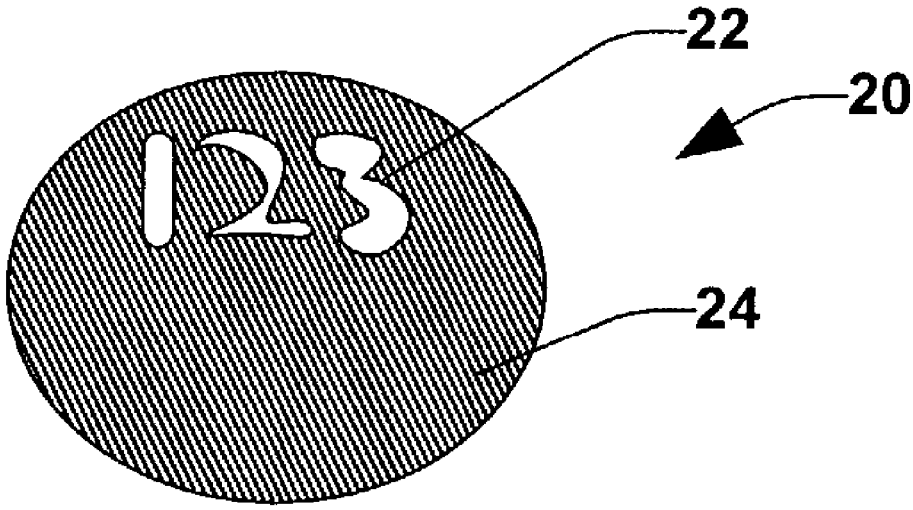
FIG. 2 is a top down view of a lens under stimulation with a logo made of hydrophilic coating disposed within a hydrophobic coating (that undergoes temporary change in response to stimuli) in accordance with one aspect of the present invention.

Referring to FIG. 2, a substrate 20 having a hydrophobic coating 24 over a portion thereof and a hydrophilic coating 22 over a portion thereof is shown. The substrate is shown just after it is exposed to stimuli. The hydrophobic coating 24 has its optical transparency lowered so that the in the hydrophilic coating 22 appears form of a logo with unchanged optical transparency. In this instance, a number becomes evident to human eye conveying information.

Amphiphlic material hydrophobic coatings can be formed on substrates by in any suitable manner. The amphiphlic material is charged to a container, such as a crucible, ampuole, or the like, and the conditions are set to effect formation of a hydrophobic coating on a substrate. Alternatively, using a composite containing a porous carrier and amphiphlic material hydrophobic coatings can be formed on substrates. The porous carrier, akin to a metal sponge in certain instances, constitutes an advantageous vehicle for facilitating the vapor deposition of a hydrophobic coating made of an amphiphlic material.

Amphiphilic molecules have the intrinsic ability to self assemble and/or self-polymerize in a coating. Amphiphilic molecules typically have head and tail groups (tail being a nonreactive, non-polar group and head being reactive, polar group). Amphiphilic molecules generally include polymerizable amphiphilic molecules, hydrolyzable alkyl silanes, hydrolyzable perhaloalkyl silanes, chlorosilanes, polysiloxanes, alkyl silazanes, perfluoroalkyl silazanes, disilazanes, and silsesquioxanes.

The polar group or moiety of the amphiphile can be a carboxylic acid, alcohol, thiol, primary, secondary and tertiary amine, cyanide, silane derivative, phosphonate, halide, and sulfonate and the like. The non-polar group or moiety mainly includes alkyl groups, per fluorinated alkyl groups, alkyl ether groups, and per-fluorinated alkyl ether groups. These non-polar groups may include diacetylene, vinyl-unsaturated or fused linear or branched aromatic rings.

In one embodiment, the amphiphilic molecule is represented by Formula I:

$$R_mSiZ_n \quad (I)$$

where each R is individually an alkyl, fluorinated alkyl, alkyl ether or fluorinated alkyl ether containing from about 1 to about 30 carbon atoms, substituted silane, or siloxane; each Z is individually one of halogens, hydroxy, alkoxy and acetoxy; and m is from about 1 to about 3, n is from about 1 to about 3, and m+n equal 4. In another embodiment, R is an alkyl, fluorinated alkyl, an alkyl ether or a fluorinated alkyl ether containing from about 6 to about 20 carbon atoms. The alkyl group may contain the diacetylene, vinyl-unsaturated, single aromatic and fused linear or branched aromatic rings.

In another embodiment, the amphiphilic molecule is represented by Formula II:

$$R_mSH_n \quad (II)$$

where R is an alkyl, fluorinated alkyl, an alkyl ether or a fluorinated alkyl ether containing from about 1 to about 30 carbon atoms; S is sulfur; H is hydrogen; m is from about 1 to about 2 and n is from 0 to 1. In another embodiment, R is an alkyl, fluorinated alkyl, an alkyl ether or a fluorinated alkyl ether containing from about 6 to about 20 carbon atoms. The alkyl chain may contain diacetylene, vinyl, single aromatics, or fused linear or branched aromatic moieties.

In yet another embodiment, the amphiphilic molecule is represented by RY, where R is an alkyl, fluorinated alkyl, an alkyl ether or a fluorinated alkyl ether containing from about 1 to about 30 carbon atoms and Y is one of the following functional groups: —COOH, —$SO_3H$, —$PO_3$, —OH, and —$NH_2$. In another embodiment, R is an alkyl, fluorinated alkyl, an alkyl ether or a fluorinated alkyl ether containing from about 6 to about 20 carbon atoms. The alkyl chain may contain diacetylene, vinyl-unsaturated, single aromatic, or fused linear or branched aromatic moieties.

In still yet another embodiment, the amphiphilic molecule may include one or more of the following Formulae (III) and (IV):

$$CF_3(CF_2)_7CH_2CH_2—Si(CH_3)_2Cl \quad (III)$$

$$CF_3(CF_2)_7CH_2CH_2—Si(OEt)_3 \quad (IV)$$

In another embodiment, the amphiphilic molecule is a disilazane represented by Formula V:

$$RSiNSiR \quad (V)$$

where R is an alkyl, fluorinated alkyl, an alkyl ether or a fluorinated alkyl ether containing from about 1 to about 30 carbon atoms. In another embodiment, R is an alkyl, fluorinated alkyl, an alkyl ether or a fluorinated alkyl ether containing from about 6 to about 20 carbon atoms.

In another embodiment, the amphiphilic molecule is represented by Formula VI:

$$R(CH_2CH_2O)_qP(O)_x(OH)_y \quad (VI)$$

where R is an alkyl, fluorinated alkyl, an alkyl ether or a fluorinated alkyl ether containing from about 1 to about 30 carbon atoms, q is from about 1 to about 10, and x and y are independently from about 1 to about 4.

Amphiphilic molecules (and in some instances compositions containing amphiphilic molecules) are described in U.S. Pat. Nos. 6,238,781; 6,206,191; 6,183,872; 6,171,652; 6,166,855 (overcoat layer); U.S. Pat. Nos. 5,897,918; 5,851,674; 5,822,170; 5,800,918; 5,776,603; 5,766,698; 5,759,618; 5,645,939; 5,552,476; and 5,081,192; Hoffmann et al., and "Vapor Phase Self-Assembly of Fluorinated Monlayers on Silicon and German Oxide," Langmuir, 13, 1877–1880, 1997; which are hereby incorporated by reference for their teachings of amphiphilic materials.

Specific examples of amphiphilic molecules and compounds that can be hydrolyzed into amphiphilic materials include octadecyltrichlorosilane; octyltrichlorosilane; heptadecafluoro-1,1,2,2-tetrahydrodecyl trichlorosilane available from Shin Etsu under the trade designation KA-7803; hexadecyl trimethoxysilane available from Degussa under the trade designation DYNASYLAN® 9116; tridecafluorooctyl triethoxysilane available from Degussa under the trade designation DYNASYLAN® F 8261; methyltrimethoxysilane available from Degussa under the trade designation DYNASYLAN® MTMS; methyltriethoxysilane available from Degussa under the trade designation DYNASYLAN® MTES; propyltrimethoxysilane available from Degussa under the trade designation DYNASYLAN® PTMO; propyltriethoxysilane available from Degussa under the trade designation DYNASYLAN® PTEO; butyltrimethoxysilane available from Degussa under the trade designation DYNASYLAN® IBTMO; butyltriethoxysilane available from Degussa under the trade designation DYNASYLAN® BTEO; octyltriethoxysilane available from Degussa under the trade designation DYNASYLAN® OCTEO; fluoroalkylsilane in ethanol available from Degussa under DYNASYLAN® 8262; fluoroalkylsilane-formulation in isopropanol available from Degussa under DYNASYLAN® F 8263; modified fluoroalkyl-siloxane available from Degussa under DYNASYLAN® F 8800; and a water-based modified fluoroalkyl-siloxane available from Degussa under DYNASYLAN® F 8810. Additional examples of amphiphilic molecules and compounds that can be hydrolyzed into amphiphilic materials include fluorocarbon compounds and hydrolyzates thereof under the trade designation OPTOOL DSX available from Daikin Industries, Ltd.; silanes under the trade designations KA-1003 (vinyltrichloro silane), KBM-1003 (vinyltrimethoxy silane), KBE-1003 (vinyltriethoxy silane), KBM-703 (chloropropyltrimethoxy silane), X-12-817H, X-71-101, X-24-7890, KP801M, KA-12 (methyldichloro silane), KA-13 (methyltrichloro silane), KA-22 (dimethyldichloro silane), KA-31 (trimethylchloro silane), KA-103 (phenyltrichloro silane), KA-202 (diphenyidichloro silane), KA-7103 (trifluoropropyl trichloro silane), KBM-13 (methyltrimethoxy silane), KBM-22 (dimethyldimethoxy silane), KBM-103 (phenyltrimethoxy silane), KBM-202SS (diphenyldimethoxy silane), KBE-13 (methyltriethoxy silane), KBE-22 (dimethyldiethoxy silane), KBE-103 (phenyltriethoxy silane), KBE-202 (diphenyldiethoxy silane), KBM-3063 (hexyltrimethoxy silane), KBE-3063 (hexyltriethoxy silane), KBM-3103 (decyltrimethoxy silane), KBM-7103 (trifluoropropyl trimethoxysilane), KBM-7803 (heptadecafluoro-1,1,2,2-tetrahydrodecyl trimethoxysilane), and KBE-7803 (heptadecafluoro-1,1,2,2-tetrahydrodecyl triethoxysilane) available from Shin Etsu.

Additional specific examples of amphiphilic materials include $C_9F_{19}C_2H_4Si(OCH_3)_3$; $(CH_3O)_3SiC_2H_4C_6F_{12}C_2H_4Si(OCH_3)_3$; $C_9F_{19}C2H_4Si(NCO)_3$; $(OCN)_3SiC_2H_4Si(NCO)_3$; $Si(NCO)_4$; $Si(OCH_3)_4$; $CH_3Si(OCH_3)_3$; $CH_3Si(NCO)_3$; $C_8H_{17}Si(NCO)_3$; $(CH_3)_2Si(NCO)$ $_2$; $C_8F_{17}CH_2CH_2Si(NCO)_3$; $(OCN)_3SiC_2H_4C_6F_{12}C_2H_4Si(NCO)_3$; $(CH_3)_3SiO[Si(CH_3)_2O]_nSi(CH_3)_3$ (viscosity of 50 centistokes); $(CH_3O)_2(CH_3)SiC_2H_4C_6F_{12}C_2H_4Si(CH_3)(OCH_3)_2$; $C_8F_{17}CH_2CH_2Si(OCH_3)_3$; dimethylpolysiloxane having a viscosity of 50 centistokes (KF96, manufactured by Shin Etsu); modified diemthylpolysiloxane having a viscosity of 42 centistokes and having hydroxyl groups at both terminals (KF6001, manufactured by Shin Etsu); and modified dimethylpolysiloxane having a viscosity of 50 centistokes and having carboxyl groups (X-22-3710, manufactured by Shin Etsu).

In another embodiment, the amphlphilic material contains a repeating unit of a polyorganosiloxane introduced into a fluoropolymer. The fluoropolymer having the repeating unit of a polyorganosiloxane can be obtained by a polymerization reaction of a fluoromonomer and a polyorganosiloxane having a reactive group as a terminal group. The reactive group is formed by chemically binding an ethylenically unsaturated monomer (e.g., acrylic acid, an ester thereof, methacrylic acid, an ester thereof, vinyl ether, styrene, a derivative thereof) to the end of the polyorganosiloxane.

The fluoropolymer can be obtained by a polymerization reaction of an ethylenically unsaturated monomer containing fluorine atom (fluoromonomer). Examples of the fluoromonomers include fluoroolefins (e.g., fluoroethylene, vinylidene fluoride, tetrafluoroethylene, hexafluoropropylene, perfluoro-2,2-dimethyl-1,3-diol), fluoroalkyl esters of acrylic or methacrylic acid and fluorovinyl ethers. Two or more fluoromonomers can be used to form a copolymer.

A copolymer of a fluoromonomer and another monomer can also be used as the amphlphilic material. Examples of the other monomers include olefins (e.g., ethylene, propylene, isoprene, vinyl chloride, vinylidene chloride), acrylic esters (e.g., methyl acrylate, ethyl acrylate, 2-ethylhexyl acrylate), methacrylic esters (e.g., methyl methacrylate, ethyl methacrylate, butyl methacrylate, ethylene glycol dimethacrylate), styrenes (e.g., styrene, vinyltoluene, .alpha-.methylstyrene), vinyl ethers (e.g., methyl vinyl ether), vinyl esters (e.g., vinyl acetate, vinyl propionate, vinyl cinnamate), acrylamides (e.g., N-tertbutylacrylamide, N-cyclohexylacrylamide), methacrylamides and acrylonitriles.

Amphiphilic molecules further include the hydrolyzation products of any of the compounds described above. In particular, treating any of the above described compounds with an acid or base yields amphiphilic materials ideally suited for forming thin film on substrates.

Amphiphilic molecules specifically include polyhedral oligomeric silsesquioxanes (POSS), and such compounds are described in U.S. Pat. Nos. 6,340734; 6,284,908; 6,057,042; 5,691,396; 5,589,562; 5,422,223; 5,412,053; *J. Am. Chem. Soc.* 1992, 114, 6701–6710; *J. Am. Chem. Soc.* 1990, 112, 1931–1936; *Chem.Rev.*1995, 95, 1409–1430; and *Langmuir,* 1994, 10, 4367, which are hereby incorporated by reference. The POSS oligomers/polymers contain reactive hydroxyl groups. Moreover, the POSS polymers/oligomers have a relatively rigid, thermally stable silicon-oxygen framework that contains an oxygen to silicon ratio of about 1.5. These compounds may be considered as characteristically intermediate between siloxanes and silica. The inorganic framework is in turn covered by a hydrocarbon/fluorocarbon outer layer enabling solubilization and derivatization of these systems, which impart hydrophobic/oleophobic properties to the substrate surface in a manner similar as alkyltrichlorosilanes.

In one embodiment the POSS polymer contains a compound represented by Formula (VII):

$$[R(SiO)_x(OH)_y]_n \quad \text{(VII)}$$

where R is an alkyl, aromatic, fluorinated alkyl, an alkyl ether or a fluorinated alkyl ether containing from about 1 to about 30 carbon atoms; x is from about 1 to about 4; y is from about 1 to about 4; and n is from about 2 to about 5,000. In another embodiment, R is an alkyl, aromatic, fluorinated alkyl, an alkyl ether or a fluorinated alkyl ether containing from about 6 to about 20 carbon atoms; x is from about 1 to about 3; y is from about 1 to about 3; and n is from about 10 to about 2,000. Such a compound can be made by stirring $RSiX_3$, such as an alkyl trihalosilane, in water and permitting it to hydrolyze, using an acid or base (such as HCl or ammonium hydroxide, respectively) to further hydrolyze the first hydrolization product.

Examples of POSS polymers include poly(p-hydroxybenzylsilsesquioxane) (PHBS); poly(p-hydroxybenzylsilsesquioxane-co-methoxybenzylsilsesquioxane) (PHB/MBS); poly(p-hydroxybenzylsilsesquioxane-co-t-butylsilsesquioxane) (PHB/BS); poly(p-hydroxybenzylsilsesquioxane-co-cyclohexylsilsesquioxane) (PHB/CHS); poly(p-hydroxybenzylsilsesquioxane-co-phenylsilsesquioxane) (PHB/PS); poly(p-hydroxybenzylsilsesquioxane-co-bicycloheptylsilsesquioxane) (PHB/BHS); poly(p-hydroxyphenylethylsilsesquioxane) (PHPES); poly(p-hydroxyphenylethylsilsesquioxane-co-p-hydroxy-α-methylbenzyls ilsesquioxane) (PHPE/HMBS); poly(p-hydroxyphenylethylsilsesquioxane-co-methoxybenzylsilsesquioxane) (PHPE/MBS); poly(p-hydroxyphenylethylsilsesquioxane-co-t-butylsilsesquioxane) (PHPE/BS); poly(p-hydroxyphenylethylsilsesquioxane-co-cyclohexylsilsesquioxane) (PHPE/CHS); poly(p-hydroxyphenylethylsilsesquioxane-co-phenylsilsesquioxane) (PHPE/PS); poly(p-hydroxyphenylethylsilsesquioxane-co-bicycloheptylsilsesquioxane) (PHPE/BHS); poly(p-hydroxy-α-methylbenzylsilsesquioxane) (PHMBS); poly(p-hydroxy-α-methylbenzylsilsesquioxane-co-p-hydroxybenzylsilsesqui (PHMB/HBS); poly(p-hydroxy-α-methylbenzylsilsesquioxane-co-methoxybenzylsilsesqu ioxane) (PHMB/MBS); poly(p-hydroxy-α-methylbenzylsilsesquioxane-co-t-butylsilsesquioxane) (PHMB/BS); poly(p-hydroxy-α-methylbenzylsilsesquioxane-co-cyclohexylsilsesquioxane) (PHMB/CHS); poly(p-hydroxy-α-methylbenzylsilsesquioxane-co-phenylsilsesquioxane) (PHMB/PS); poly(p-hydroxy-α-methylbenzylsilsesquioxane-co-bicycloheptylsilsesquioxane) (PHMB/BHS); and poly(p-hydroxybenzylsilsesquioxane-co-p-hydroxyphenylethylsilsesquioxane) (PHB/HPES).

The amphiphilic molecules are stored in a container, ampoule, placed in a crucible, or incorporated on and/or into a porous carrier to form a composite that facilitates the coating process. The porous carrier composite may be stored in an air tight or otherwise protected container. The porous carrier may function and/or look like a sponge.

In order to facilitate storing and/or loading the amphiphilic molecules to a container, ampoule, crucible, or porous carrier, the amphiphilic molecules may be optionally combined with a solvent. It is desirable that the amphiphilic molecules are substantially uniformly distributed throughout the porous carrier.

Solvents to which the amphiphilic molecules may be combined are generally non-polar organic solvents. Such solvents typically include alcohols such as isopropanol; alkanes such as cyclohexane and methyl cyclohexane; aromatics such as toluene, trifluorotoluene; alkylhaolsilanes, alkyl or fluoralkyl substituted cyclohexanes; ethers; perfluorinated liquids such as perfluorohexanes; and other hydrocarbon containing liquids. Examples of perfluorinated liquids include those under the trade designation Fluorinert™ and Novec™ available from 3M. When combining the amphiphilic molecules with one or more solvents, heat may be optionally applied to facilitate formation of a uniform mixture.

A coating catalyst and/or a quencher may be combined with the amphiphilic material or mixture of amphiphilic material and solvent to facilitate the coating process. Coating catalysts include metal chlorides such as zinc chloride and aluminum chloride, and mineral acids while quenchers include zinc powders and amines. Each is present in the amphiphilic material or mixture of amphiphilic material and solvent in an amount from about 0.01% to about 1% by weight.

The container, ampoule, crucible, or porous carrier containing the mixture of amphiphilic material and solvent may be treated to remove the solvent or substantially all of the solvent by any suitable means. For example, evaporation or vacuum distillation may be employed. After solvent is removed, heat is applied until a constant weight is achieved. In this instance, heating at a temperature from about 40 to about 100° C. is useful. In most instances, the amphiphilic material solidifies, becomes semi-solid, or becomes a low viscosity liquid and is retained in the container, ampoule, crucible, or pores of the porous carrier.

The container, ampoule, crucible, or porous carrier may be made of any material inert to the amphiphilic molecules, such as porcelain, glass, pyrex, metals, metal oxides, and ceramics. Specific examples of materials that may form the porous carrier include one or more of alumina, aluminum silicate, aluminum, brass, bronze, chromium, copper, gold, iron, magnesium, nickel, palladium, platinum, silicon carbide, silver, stainless steel, tin, titanium, tungsten, zinc, zirconium, Hastelloy®, Kovar®, Invar, Monel®, Inconel®, and various other alloys.

Examples of porous carriers include those under the trade designation Mott Porous Metal, available from Mott Corporation; those under the trade designation Kellundite available from Filtros Ltd.; and those under the trade designations Metal Foam, Porous Metal Media and Sinterflo®, available from Provair Advanced Materials Inc.

Coating techniques involve exposing the substrate to the amphiphilic molecules in the container, ampoule, crucible, or on the porous carrier in a chamber or closed environment under at least one of reduced pressure, elevated temperature, irradiation, and power. Preferably, reduced pressure and/or elevated temperatures are employed. The reduced pressure, elevated temperatures, irradiation, and/or power imposed induce vaporization or sublimation of the amphiphilic molecules into the chamber atmosphere and subsequent self assembly and/or self-polymerization on the substrate surface in a uniform and continuous fashion thereby forming the hydrophobic coating.

In one embodiment, the substrate is exposed to the amphiphilic molecules under a pressure from about 0.000001 to about 760 torr (specifically including no applied vacuum). In another embodiment, the substrate is exposed to the amphiphilic molecules under a pressure from about 0.00001 to about 200 torr. In yet another embodiment, the substrate is exposed to the amphiphilic molecules under a pressure from about 0.0001 to about 100 torr.

In one embodiment, the amphiphilic molecules is heated to a temperature from about 20 to about 400° C. In another embodiment, the amphiphilic molecules is heated to a temperature from about 40 to about 350° C. In yet another embodiment, the amphiphilic molecules is heated to a temperature from about 50 to about 300° C. Only the amphiphilic molecules need to be at the temperature described above to induce coating formation. The substrate is at about the same or at a different temperature as the amphiphilic molecules in the chamber. The amphiphilic molecules are at about the same or at a different temperature as the atmosphere of the chamber. The substrate is at about the same or at a different temperature as the atmosphere of the chamber. In one embodiment, each of the substrate, amphiphilic molecules, and atmosphere is at a temperature from about 20 to about 400° C.

General examples of coating forming techniques include dipping (in a coating solution); wet application (spraying, wiping, printing, stamping); vapor deposition; vacuum deposition; vacuum coating; box coating; sputter coating; vapor deposition or chemical vapor deposition (CVD) such as low pressure chemical vapor deposition (LPCVD), plasma enhanced chemical vapor deposition (PECVD), high temperature chemical vapor deposition (HTCVD); and sputtering. Such techniques are known in the art and not described for brevity sake.

Vapor deposition/chemical vapor deposition techniques and processes have been widely disclosed in literature, for example: *Thin Solid Films,* 1994, 252, 32–37; *Vacuum technology* by Ruth A. 3rd edition, Elsevier Publication, 1990, 311–319; *Appl. Phys. Lett.* 1992, 60, 1866–1868; *Polymer Preprints,* 1993, 34,427–428; U.S. Pat. Nos. 6,265,026; 6,171,652; 6,051,321; 5,372,851; and 5,084,302, which are hereby incorporated by reference for their teachings in forming coatings or depositing organic compounds on substrates.

The amphiphilic material and/or film formed therefrom has reactive hydroxyl groups, which become involved in chemical bonding (hydrogen and/or covalent) to the substrate. As the substrate surface reacts with moisture (airborne water molecules), making covalent bonds to the surface, similar to self-assembley of layers, thus providing permanent transparent uniform thin coating, which has excellent hydrophobic/oleophobic properties.

In one embodiment, the hydrophilic coating is formed by depositing or growing a metal oxide coating on a substrate. Metal oxides include silica, titania, alumina, chromia, tantalum oxide, zirconia, yttria, zinc oxide, magnesia, vanadia, indium oxide, tin oxide, germanium oxide, hafnium oxide, potassium oxide, sodium oxide, calcium oxide, and the like. Alternatively, the hydrophilic coating is formed by depositing/growing a metal nitride, such as silicon nitride, titanium nitride, tantalum nitride, carbon nitride, boron nitride, hafnium nitride, zirconium nitride, silicon oxynitride, and the like or a metal carbide, such as boron carbide, silicon carbide, germanium carbide, metal fluorides such as magnesium fluoride, and the like. In one embodiment, the hydrophilic coating is formed by depositing or growing two or more metal oxides, metal nitrides, metal carbides, and/or metal fluorides coatings on a substrate.

In another embodiment, the hydrophilic coating is formed by polymerizing a silicon containing compound, such as silicates such as tetraethylorthosilicate (TEOS), phosphosilicate glass (PSG), fluorosilicate glass (FSG), borophosphosilicate glass (BPSG), borophospho-tetraethylorthosilicate (BPTEOS), germanium phosphosilicate, and germanium posophosphosilicate, and hydrophilic silanes such as tetramethoxysilane, and tetraethoxysilane.

The coating forming techniques of dipping (in a coating solution); wet application (spraying, wiping, printing, stamping); vapor deposition; vacuum deposition; vacuum coating; box coating; sputter coating; vapor deposition or CVD such as LPCVD, PECVD, HTCVD; and sputtering may be employed to form the above hydrophilic coatings. Spin-on techniques may also be employed to form some of the above hydrophilic coatings. In vacuum coating, for example, hydrophilic coating is formed by initially forming a magnesium fluoride coating, then depositing thereover a 1 to 10 nm thick silica thereover under vacuum at a temperature from about 200° C. to about 300° C.

In yet another embodiment, the hydrophilic coating is formed by oxidizing the hydrophobic coating (or a portion of the hydrophobic coating) described above. Oxidation may be effected by heating the hydrophobic coating in an oxygen containing atmosphere to convert it to a hydrophilic coating and/or contacting the hydrophobic coating with an oxidizing agent to convert it to a hydrophilic coating.

In embodiments where a hydrophobic coating is formed over a substrate surface followed by forming a hydrophilic coating over the hydrophobic coating, and then removing portions of the hydrophilic coating using an etching solution to expose portions of the initially formed hydrophobic coating, or where a hydrophilic coating is formed over a substrate surface followed by forming a hydrophobic coating over the hydrophilic coating, and then removing portions of the hydrophobic coating using an etching solution to expose portions of the initially formed hydrophilic coating, the etching solution typically contains a water or liquid carrier and an etchant. The etching solution patterns an opening in either the hydrophobic coating or hydrophilic coating to facilitate formation of an invisible logo.

Examples of etchants include fluoride compounds such as ammonium bifluoride, sodium bifluoride, potassium bifluoride; acids such as sulfuric acid, hydrochloric acid, phosphoric acid, nitric acid, acetic acid and other organic acids; hydrogen peroxide; bases such as sodium hydroxide, potassium hydroxide, sodium carbonate/bicarbonate, and the like. One commercially available solution useful for etching includes those by the trade designation Klenztone available from K & E Chemical Co. Carriers for the etchants include water and/or organic liquids. The organic liquids may or may not be water soluble. Examples of organic liquids that are water soluble include polyvinyl alcohol. The etching solution optionally contains one or more additives, such as an emulsifier, thickener, viscosity control agent, and the like.

The etching solution may be applied to a masked substrate, or the etching solution may be neatly applied using an applicator such a stamp, brush or pen. When using an applicator, only a discrete amount of etching solution is applied, so that the solution does not cover areas where it is not intended to cover. Typically, the etching solution is in contact with the substrate having one or more of a hydrophobic coating and a hydrophilic coating thereon for a sufficient period of time to effect removal of the covered portion of the hydrophobic coating or hydrophilic coating (whichever is covered with the etching solution). Optionally, the substrate is simply rinsed with water after the sufficient period of time is passed.

The mask can be applied directly to the substrate and used in accordance with known photolithography techniques. Alternatively, the mask can be an ink mask stamped directly on the substrate surface. The application of the ink mask on the substrate can be effected at a stamping station. The stamping station can include an ink plate supplied with ink from an associated ink pot and an ink pad. Prior to stamping, the reciprocating ink pad is brought into engagement with the ink plate arranged for translatory movement to pick up ink. The face of the ink pad has a reverse image of the desired invisible logo. That is, the mask contains openings that correspond to the subsequently formed invisible logo. After inking, the pad is brought into contact with the substrate to be stamped. The ink pad may be made of any suitable material. An ink pad of Shore hardness 8, ref. 4070, manufactured by Equipements Moreau may be employed. The stamping station may incorporate an MD 80GF model stamping unit manufactured by Morlock. After applying the ink mask to the substrate, the ink may be dried and/or polymerized. Any suitable drying or polymerization means may be used for such purpose, such as ultraviolet lamp.

After drying or polymerization, the ink masked substrate is processed (application of hydrophobic/hydrophilic coating or etching of hydrophobic/hydrophilic coating). After processing, the substrate is taken by the positioning means to a cleaning station where the ink mask is removed from the substrate. Alternatively, the ink mask may be removed and the substrate cleaned subsequently. Such an ink mask ensures very precise delineation of the desired logo marking.

In one embodiment, the etching solution is in contact with the substrate having one or more of a hydrophobic coating and a hydrophilic coating thereon to etch one of the hydrophobic/hydrophilic coating for a time from about 1 second to about 5 hours. In another embodiment, the etching solution is in contact with the substrate having one or more of a hydrophobic coating and a hydrophilic coating thereon to etch one of the hydrophobic/hydrophilic coating for a time from about 5 seconds to about 10 minutes. The time generally depends on one or more of the precise concentration of the etchant in the carrier, the identities of the etchant and hydrophobic/hydrophilic coatings, and the thickness of the hydrophobic/hydrophilic coatings. Any concentration that facilitates etching may be employed, and this concentration may be determined by one skilled in the art using routine experimentation.

The methods and composites of the present invention are advantageous for providing thin hydrophobic and hydrophilic coatings on substrates. Substrates include those with porous and non-porous surfaces such as glasses, ceramics, porcelains, fiberglass, metals, and organic materials including thermosets such as polycarbonate, and thermoplastics, and ceramic tile. Additional organic materials include polystyrene and its mixed polymers, polyolefins, in particular polyethylene and polypropylene, polyacrylic compounds, polyvinyl compounds, for example polyvinyl chloride and polyvinyl acetate, polyesters and rubber, and also filaments made of viscose and cellulose ethers, cellulose esters, polyamides, polyurethanes, polyesters, for example polyglycol terephthalates, and polyacrylonitrile.

Glasses specifically include lenses, such as eyewear lenses, microscope slides, decorative glass pieces, plastic sheets, mirror glass, papers, ceramic or marble tile, vehicle/automobile windows, shower doors, building windows and doors, binocular lenses, microscope lenses, telescope lenses, camera lenses, video lenses, televison screens, computer screens, LCDs, mirrors, prisms, and the like.

The coatings formed on the substrate generally have a uniform thickness over the substrate, within that portion of the substrate (the hydrophobic coating is uniformly thick where the hydrophobic coating is formed). In one embodiment, the thickness of the coatings are independently from about 0.1 nm to about 250 nm. In another embodiment, the thickness of the coatings are independently from about 1 nm to about 200 nm. In yet another embodiment, the thickness of the coatings are independently is from about 2 nm to about 100 nm. In still yet another embodiment, the thickness of the coatings are independently from about 5 nm to about 20 nm. In another embodiment, the thickness of the coatings are independently about 10 nm or less. The thickness of the coatings may be controlled by adjusting the deposition parameters.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of making an invisible logo undetectable to a human eye on a substrate, comprising:

forming a hydrophilic coating over a first portion of the substrate; and forming a hydrophobic coating comprising an amphiphilic material over a second portion of the substrate so that the hydrophobic coating retains liquid beads on a surface of the hydrophobic coating, the hydrophobic coating capable of undergoing a temporary visible change in response to stimuli thereby forming a visible logo detectable by a human eye, the amphiphilic material comprising a nonreactive non-polar tail group and a reactive polar head group;

wherein the hydrophilic coating and the hydrophobic coating are positioned to form the invisible logo.

2. The method of claim 1, the hydrophilic coating is formed by one selected from the group consisting of wet application; vapor deposition; vacuum deposition; vacuum coating; box coating; sputter coating; chemical vapor deposition; sputtering; and spin-on techniques.

3. The method of claim 1, the hydrophobic coating is formed by one selected from the group consisting of wet application; vapor deposition; vacuum deposition; vacuum coating; box coating; sputter coating; chemical vapor deposition; sputtering; and spin-on techniques.

4. The method of claim 1, the hydrophobic coating is formed by vapor deposition using a porous carrier.

5. The method of claim 1, the hydrophilic coating is formed over a substantial portion of the substrate, a mask with openings corresponding to the invisible logo exposing portions of the hydrophilic coating is formed over the hydrophilic coating, oxidizing the exposed portions of the hydrophilic coating to form a hydrophobic coating within the openings of the mask, and removing mask from the substrate.

6. The method of claim 1, the hydrophilic coating is formed over a substantial portion of the substrate, a mask with openings corresponding to the invisible logo is formed over the hydrophilic coating, the hydrophobic coating is formed within the openings of the mask, and mask is removed from the substrate.

7. The method of claim 1, the hydrophilic coating is formed over a substantial portion of the substrate, the hydrophobic coating is formed over the hydrophilic coating, and an etching solution is contacted with portions of the hydrophobic coating to remove those portions of the hydrophobic coating.

8. The method of claim 1, the optical transparency of the hydrophobic coating is temporarily lowered by at least about 20%.

9. The method of claim 1, the optical transparency of the hydrophobic coating is temporarily lowered by at least about 30%.

10. The method of claim 1, the amphiphilic material comprises polymerizable amphiphilic molecules, hydrolyzable alkyl silanes, hydrolyzable perhaloalkyl silanes, chlorosilanes, polysiloxanes, alkyl silazanes, perfluoroalkyl silazanes, disilazanes, or silsesquioxanes.

11. A method of making an invisible logo undetectable to a human eye on a substrate, comprising:

forming a hydrophobic coating over a first portion of the substrate, the hydrophobic coating comprising an amphiphilic material, the hydrophobic coating being formed in patterns to retain liquid beads on a surface of the hydrophobic coating for undergoing a temporary reduction in an optical transparency of the hydrophobic coating in response to stimuli thereby forming a visible logo detectable by a human eye; and forming a hydrophilic coating over a second portion of the substrate;

wherein the hydrophilic coating and the hydrophobic coating are positioned to form the invisible logo.

12. The method of claim 11, the hydrophobic coating is formed by one of vapor deposition or wet application.

13. The method of claim 11, the hydrophilic coating is formed by one selected from the group consisting of vacuum deposition; vacuum coating; sputter coating; and chemical vapor deposition.

14. A method of making an invisible logo undetectable to a human eye on a substrate, comprising:

forming a hydrophilic coating over a first portion of the substrate so that the hydrophilic coating retains liquid beads on a surface of the hydrophilic coating to undergo a temporary reduction in an optical transparency of the hydrophilic coating in response to stimuli thereby forming a visible logo detectable by a human eye; and forming a hydrophobic coating comprising an amphiphilic material over a second portion of the substrate, the amphiphilic material comprising a non-reactive non-polar tail group and a reactive polar head group;

wherein the hydrophilic coating and the hydrophobic coating are positioned to form the invisible logo.

15. The method of claim 14, the optical transparency of the hydrophilic coating is temporarily lowered by at least about 20%.

16. The method of claim 14, the optical transparency of the hydrophilic coating is temporarily lowered by at least about 30%.

17. The method of claim 14, the amphiphilic material comprises polymerizable amphiphilic molecules, hydrolyzable alkyl silanes, hydrolyzable perhaloalkyl silanes, chlorosilanes, polysiloxanes, alkyl silazanes, perfluoroalkyl silazanes, disilazanes, or silsesquioxanes.

18. The method of claim 14, the hydrophobic coating is formed by one of Wet application; vapor deposition; vacuum deposition; vacuum coating; box coating; sputter coating; chemical vapor deposition; sputtering; and spin-on techniques.

19. The method of claim 14, the hydrophilic coating is formed by vacuum deposition.

20. The method of claim 14, the amphiphilic material comprises hydrolyzable perhaloalkyl silanes, polysiloxanes, alkyl silazanes, perfluoroalkyl silazanes, or silsesquioxanes.

* * * * *